US009850056B2

(12) United States Patent
Shaw et al.

(10) Patent No.: US 9,850,056 B2
(45) Date of Patent: Dec. 26, 2017

(54) OVENABLE PACKAGE WITH MULTIPLE LAYER FILM LID AND RESEALABLE ADHESIVE BETWEEN THE LAYERS

(71) Applicant: PARKSIDE FLEXIBLES (EUROPE) LIMITED, Derbyshire (GB)

(72) Inventors: Mark Shaw, Derbyshire (GB); Mark Hill, Derbyshire (GB)

(73) Assignee: PARKSIDE FLEXIBLES (EUROPE) LIMITED, Derbyshire (GB)

( * ) Notice: Subject to any disclaimer, the term of this patent is extended or adjusted under 35 U.S.C. 154(b) by 35 days.

(21) Appl. No.: 15/349,735

(22) Filed: Nov. 11, 2016

(65) Prior Publication Data

US 2017/0057728 A1 Mar. 2, 2017

Related U.S. Application Data

(63) Continuation of application No. PCT/GB2016/050653, filed on Mar. 10, 2016.

(30) Foreign Application Priority Data

Mar. 26, 2015 (GB) ..... 1505103.0

(51) Int. Cl.
*B65D 41/00* (2006.01)
*B65D 81/34* (2006.01)
(Continued)

(52) U.S. Cl.
CPC ..... *B65D 81/34* (2013.01); *B65D 25/04* (2013.01); *B65D 65/40* (2013.01);
(Continued)

(58) Field of Classification Search
CPC .... B65D 81/34; B65D 25/04; B65D 77/2096; B65D 81/343; B65D 81/3446; B65D 77/30; B65D 65/40; B65D 2577/2091
(Continued)

(56) References Cited

U.S. PATENT DOCUMENTS 5,039,001 A * 8/1991 Kinigakis ..... B65D 77/225 220/359.3
5,125,529 A 6/1992 Torterotot
(Continued)

FOREIGN PATENT DOCUMENTS

DE 20 2014 105885 U1 1/2015
EP 1 122 189 A1 8/2001
(Continued)

OTHER PUBLICATIONS

Search Report in Great Britain Patent Application No. 1505103.0, dated Sep. 25, 2015.

*Primary Examiner* — Kareen Thomas
(74) *Attorney, Agent, or Firm* — Baker & Hostetler LLP

(57) ABSTRACT

An ovenable package comprises an ovenable receptacle configured to hold a food product. The receptacle has an open face surrounded by a rim. An ovenable laminated film lid is attached to the rim of the receptacle by a welded seal between a lower face of the laminated film lid and the rim of the receptacle. The laminated film lid comprises a first layer, a second layer above the first layer and a resealable adhesive between the first and second layers. An unopened package is openable by separating the second layer from the first layer in a peripheral region. The opened package can be reclosed to a ventable state by reattaching the second layer to the peripheral region of the first layer by the resealable adhesive. The ventable state permits venting of gas from an interior of the receptacle between the second layer and the peripheral region of the first layer.

17 Claims, 10 Drawing Sheets

(51) Int. Cl.

| | |
|---|---|
| ***B65D 77/20*** | (2006.01) |
| ***B65D 25/04*** | (2006.01) |
| ***B65D 65/40*** | (2006.01) |
| ***B65D 77/30*** | (2006.01) |

(52) U.S. Cl.
CPC ..... *B65D 77/2096* (2013.01); *B65D 77/30* (2013.01); *B65D 81/343* (2013.01); *B65D 81/3446* (2013.01); *B65D 2205/00* (2013.01); *B65D 2577/2091* (2013.01)

(58) Field of Classification Search
USPC ..... 220/359.1, 359.2, 359.3, 359.4, 367.1, 220/366.1, 260, 265, 266, 270, 276, 220/203.08, 202, 203.11; 428/35.7, 35.8, 428/36.91, 36.92; 383/210, 210.1, 211, 5
See application file for complete search history.

(56) References Cited

U.S. PATENT DOCUMENTS

| | | | | |
|---|---|---|---|---|
| 6,056,141 | A * | 5/2000 | Navarini | B32B 27/06 220/269 |
| 6,182,850 | B1 * | 2/2001 | Marbler | B65D 77/225 220/359.3 |
| 6,395,318 | B1 * | 5/2002 | Sumpmann | B65D 15/08 220/359.3 |
| 6,790,508 | B2 * | 9/2004 | Razeti | B32B 7/12 215/232 |
| 8,256,636 | B2 * | 9/2012 | Huffer | B65D 77/2036 220/266 |
| 8,308,363 | B2 * | 11/2012 | Vogt | B65D 75/5838 220/258.3 |
| 8,746,490 | B2 * | 6/2014 | Huffer | B32B 27/32 156/247 |
| 9,150,342 | B2 * | 10/2015 | Sierra-Gomez | B65D 77/206 |
| 2004/0118852 | A1 * | 6/2004 | Barmore | B65D 77/2044 220/359.2 |

FOREIGN PATENT DOCUMENTS

| | | | |
|---|---|---|---|
| EP | 1 939 107 | A1 | 7/2008 |
| EP | 2 778 094 | A1 | 9/2014 |
| JP | H11-278513 | A | 10/1999 |
| TW | 455556 | B | 9/2001 |
| WO | 2015/189756 | A1 | 12/2015 |

* cited by examiner

OVENABLE PACKAGE WITH MULTIPLE LAYER FILM LID AND RESEALABLE ADHESIVE BETWEEN THE LAYERS

CROSS-REFERENCE TO RELATED APPLICATIONS

This application is a continuation of International patent application PCT/GB2016/050653, filed on Mar. 10, 2016, which claims priority to foreign Great Britain patent application No. GB 1505103.0, filed on Mar. 26, 2015, the disclosures of which are incorporated by reference in their entirety.

BACKGROUND

Food products such as pre-prepared ready meals are packaged ready for heating in an oven.

The package comprises a receptacle to hold the food, such as a tray. A lidding film is attached to the tray. The film protects the food from the environment, and gives the food a useful shelf life. Typically the tray is further packaged within an outer sleeve, such as a card sleeve bearing product information.

In use, a user removes the outer packaging, such as the card sleeve, punctures the lidding film and then places the package into an oven for heating. After heating, the lid is removed and the food is consumed directly from the tray, or transferred from the tray before consumption.

It is known to attach the lidding film to the rim of the tray by a resealable adhesive. However, the failure rate of this type of package is relatively high. Rough handling during transit, or at a point of sale, can cause the lid to separate from the tray, spoiling the contents of the package.

Another known way of attaching the lidding film to the rim of the tray is by a welded seal. This provides a stronger, more reliable, seal but has a disadvantage that the lidding film can shred when a user tries to remove the film from the tray after heating.

There is a requirement for alternative packaging.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An aspect of the disclosure provides an ovenable package comprising:

an ovenable receptacle configured to hold a food product, the receptacle having an open face surrounded by a rim;

an ovenable laminated film lid attached to the rim of the receptacle by a welded seal between a lower face of the laminated film lid and the rim of the receptacle, the welded seal extending continuously around the rim of the receptacle, the laminated film lid comprising at least:

a first layer;

a second layer above the first layer;

a cut line in the first layer but not the second layer, the first cut line offset inwardly from the rim of the receptacle to define a peripheral portion of the first layer between the cut line and an outer perimeter of the lid and an inner portion of the first layer within the cut line;

a resealable adhesive between at least the peripheral portion of the first layer and the second layer;

wherein an unopened package is openable by separating the second layer from the first layer in the peripheral region, and wherein the opened package can be reclosed to a ventable state by reattaching the second layer to the peripheral region of the first layer by the resealable adhesive, wherein the ventable state permits venting of gas from an interior of the receptacle between the second layer and the peripheral region of the first layer.

The resealable adhesive may be more strongly attached to the second layer than the first layer such that the resealable adhesive is carried by the second layer when the second layer is separated from the first layer.

The inner portion of the first layer may be a flap, the cut line defining an open path with a first end point and a second end point.

The cut line may form a closed path.

The laminated film lid may extend beyond the rim of the receptacle.

The laminated film lid may comprise a tab portion, the film lid extending beyond the rim by a greater distance at the tab portion compared to the remainder of the film lid.

The cut line may be offset inwardly from the rim by a larger distance proximate the tab portion.

The tab portion may be located at a corner of the receptacle, wherein the cut line is offset inwardly from the rim by a larger distance at the corner.

Only a resealable adhesive may be provided between the first layer and the second layer.

A bond strength of the resealable adhesive may be lower on the peripheral portion of the first layer compared to the inner portion of the first layer.

Resealable adhesive may be provided between the peripheral portion of the first layer and the second layer, and a permanent adhesive is provided between the inner portion of the first layer and the second layer.

The laminated film lid may be printed on an outer face of the second layer.

The laminated film lid may be printed between the second layer and the first layer.

The laminated film lid may be printed between the second layer and the first layer only above the inner portion of the first layer.

Another aspect of the disclosure provides an ovenable laminated film lid configured to attach to a rim of an ovenable receptacle to hold a food product, the ovenable laminated film comprising:

a first layer configured to seal to the rim of the receptacle;

a second layer above the first layer;

a cut line in the first layer but not the second layer, the first cut line offset inwardly from the rim of the receptacle to define a peripheral portion of the first layer between the cut line and an outer perimeter of the lid and an inner portion of the first layer within the cut line;

a resealable adhesive between at least the peripheral portion of the first layer and the second layer;

wherein the lid is openable by separating the second layer from the first layer in the peripheral region, and wherein the lid can be reclosed to a ventable state by reattaching the second layer to the peripheral region of the first layer by the resealable adhesive, wherein the ventable state permits venting of gas from an interior of the receptacle between the second layer and the peripheral region of the first layer.

In this specification, the term "resealable adhesive" means an adhesive which allows two surfaces to adhere to one another and which also allows the surfaces to be separated non-destructively from one another and to re-adhere to one another. An example of a resealable adhesive is a Pressure Sensitive Adhesive (PSA), such as a peelable PSA, where an adhesive bond is achieved by applying pressure to the adhesive.

In this specification, the term "ovenable package" means the package is formed of an oven grade material which is capable of withstanding heating in an oven, such as a conventional oven (gas, electric) or microwave oven for a cooking period. Typically the cooking period is less than one hour.

In this specification, the term "resealed" means that two surfaces can be refastened to one another. A degree of sealing may be achieved between the two surfaces when they are refastened to one another. However, the term "resealed" does not require the two surfaces to form a fully airtight seal during the subsequent fastening of the surfaces.

The preferred features may be combined as appropriate, as would be apparent to a skilled person, and may be combined with any of the aspects of the invention.

BRIEF DESCRIPTION OF THE DRAWINGS

Embodiments of the invention will be described, by way of example, with reference to the following drawings, in which.

Figure 1:
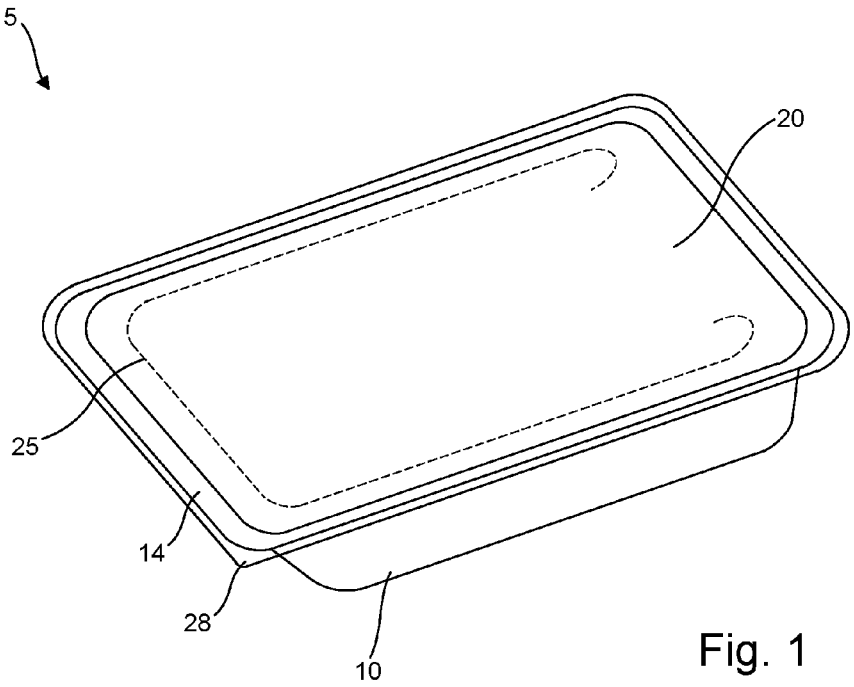
FIG. 1 shows an ovenable package.

Common reference numerals are used throughout the figures to indicate similar features.

DETAILED DESCRIPTION

Embodiments of the present invention are described below by way of example only. These examples represent the best ways of putting the invention into practice that are currently known to the Applicant although they are not the only ways in which this could be achieved. The description sets forth the functions of the example and the sequence of steps for constructing and operating the example. However, the same or equivalent functions and sequences may be accomplished by different examples.

Figure 2:
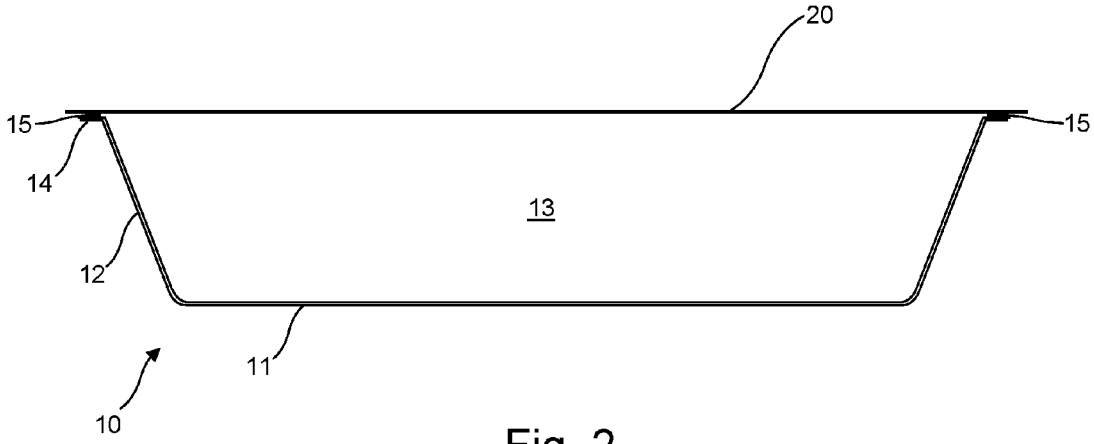
FIG. 2 shows a cross-section through the package of FIG. 1.
Figure 3:
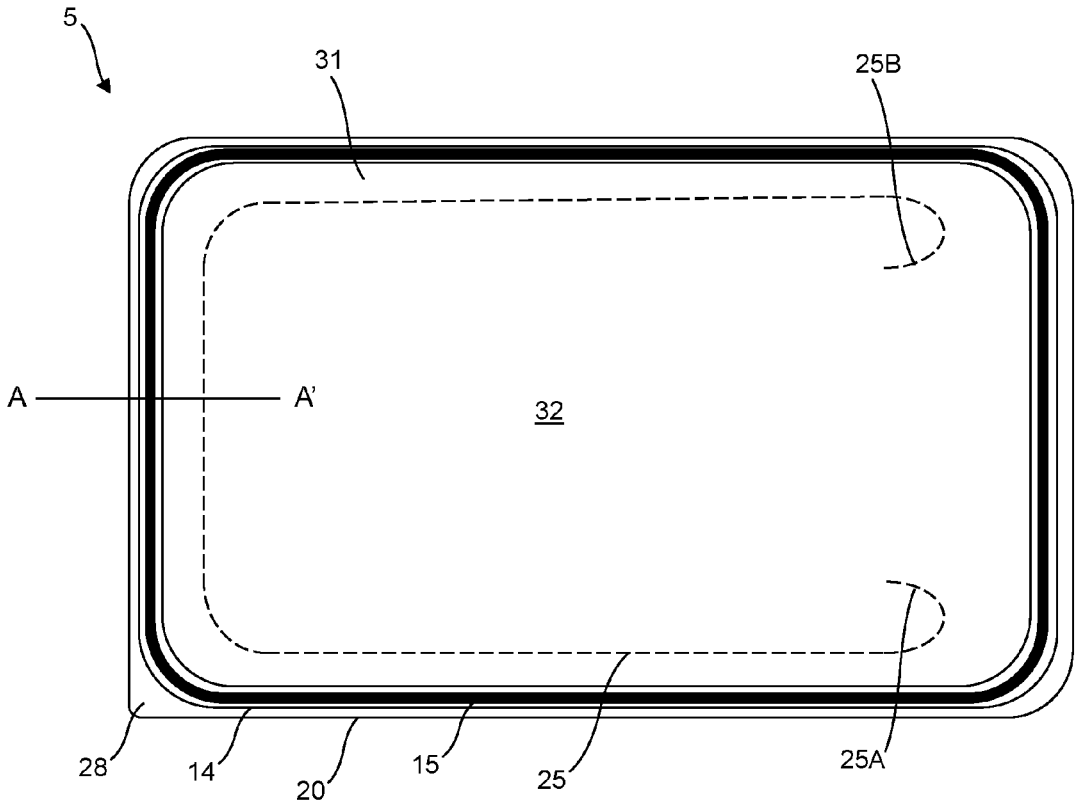
FIG. 3 shows a top view of the package of FIG. 1.

FIGS. 1 to 3 show an example ovenable package 5. The package 5 comprises an ovenable receptacle 10 and an ovenable lidding film 20. The receptacle 10 can be in the form of a tray, pot, tub or similar receptacle for holding a food product. An embodiment will be described where the receptacle is a tray 10. The tray 10 can be rectangular (as shown), square, circular, oval or any other desired shape. The ovenable receptacle is formed of an oven grade material. The oven grade material can withstand heating in an oven for a typical cooking period, without melting or deforming. Similarly, the ovenable lidding film is formed of an oven grade material. The oven grade material is able to withstand heating in an oven for a typical cooking period without melting. Typically, food is heated in a conventional gas or electric oven at temperatures up to 220° C. for a period of up to one hour. Examples of suitable oven grade materials for the receptacle 10 are Crystalline Polyethylene Terephthalate (CPET), bagasse, carton board (coated/uncoated), pulp trays. Examples of suitable oven grade materials for the lidding film 20 are polyester based film, such as Polyethylene terephthalate (PET), polyactic acid (PLA) film, cellulose, or any other suitable oven-grade polymer. The film should not become brittle, melt or release toxins when subjected to temperatures up to 220° C.

The tray 10 has a base 11, a peripheral wall 12 and a rim or flange 14. The base 11 and peripheral wall 12 define an interior volume 13 for holding a quantity of a food product. The base 11 allows the package to remain upright when it is heated in an oven. The food product may comprise any kind of food product, such as a pre-prepared meal, vegetables, fruit, meat or fish. A lidding film 20 is attached to the top face of the tray 10. The lidding film 20 is attached to the rim 14 of the tray 10. As will be described in more detail below, the lidding film 20 is a multi-layer laminate comprising at least two layers 21, 22. The lower layer 21 of the lidding film 20 is sealed 15 to the rim 14 of the tray, such as by a welded seal. The seal 15 is continuous around the rim 14 of the tray 10. Adhesive is present between the lidding film 20 and the rim 14. The adhesive can be heat seal adhesive. This is a non-resealable non-tacky adhesive which is typically coated onto the lidding film. A welded seal is formed by applying heat to the lidding film where the lidding film overlies the rim 14 of the tray. This creates a permanent seal. The heat seal adhesive can be locally applied where a seal is required (i.e. a region of the lidding film where the lidding film will overlie a rim of a tray) or the heat seal adhesive can be applied as a layer across the entire underside of the lidding film. Providing a fully coated lidding film can save tooling costs incurred when pattern applying. An example thickness of the heat seal is 0.5-15 μm.

The first, lower, layer 21 of the lidding film 20 has a cut line 25. The cut line 25 is offset inwardly from the rim 14 of the tray. The cut line 25 defines: (i) a peripheral portion 31 of the first layer 21 between the cut line 25 and an outer perimeter of the lid 20; and (ii) an inner portion 32 of the first layer 21 within the cut line 25. In the example of FIG. 3, the cut line 25 is defined along substantially three sides of the tray. The cut line 25 defines an inner portion 32 of the first layer 21 which is a flap. In the example of FIG. 3, the ends 25A, 25B of the cut line 25 are curved back along the direction of the cut line 25 through 180 degrees. This helps to prevent opening of the first layer beyond the end of the cut line 25 during an initial opening.

The lidding film 20 has a tab 28 which a user can grasp to open the package. For a square or rectangular package, as shown in FIGS. 1 to 3, the tab can be located at a corner of the package. The tab 28 is a portion of the lidding film which extends beyond the rim for a larger distance than at other points around the rim. The tab 28 extends beyond the rim by a distance which is sufficient for a user to grasp.

Figure 4:
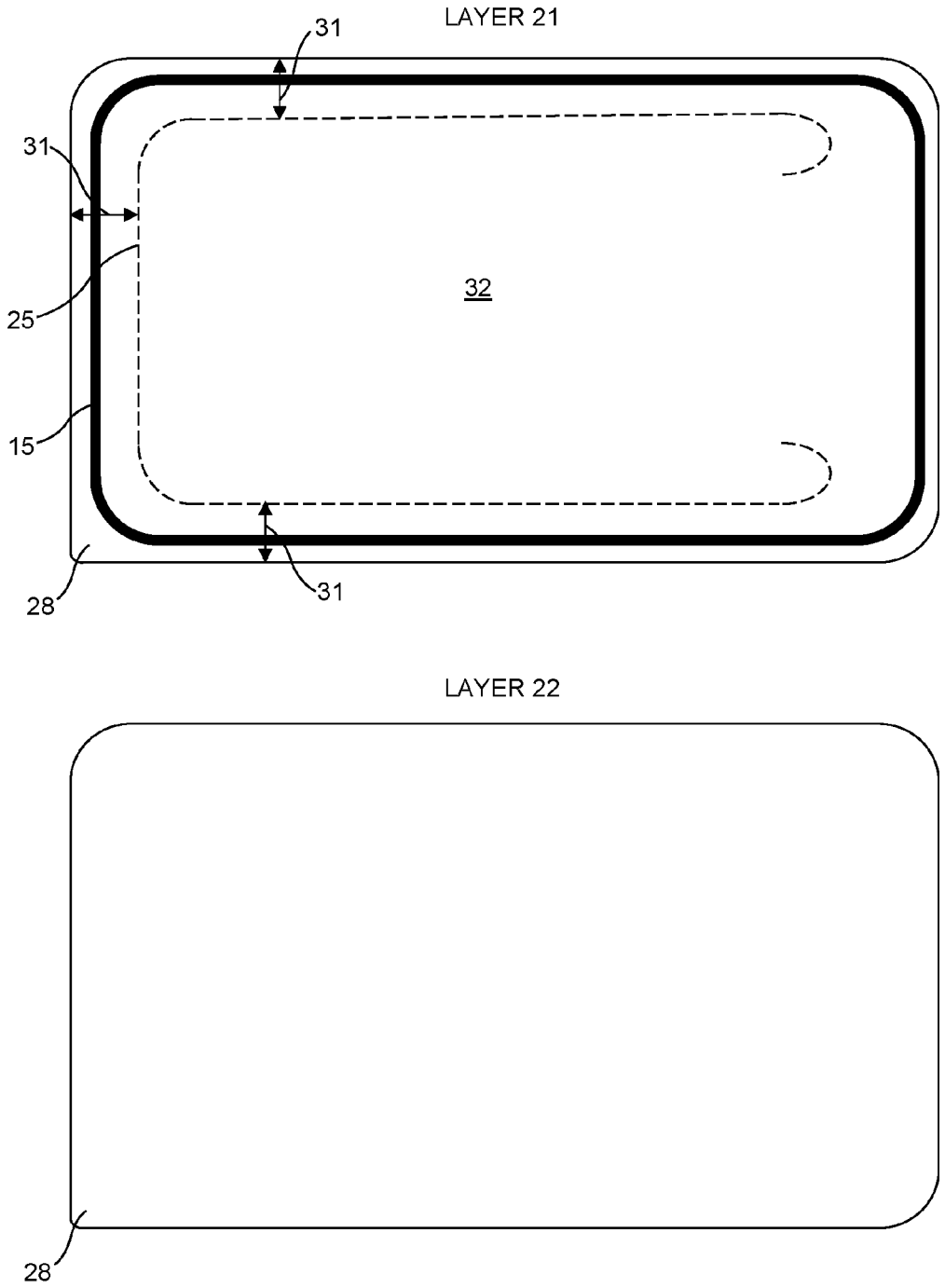
FIG. 4 shows layers of laminated film lid of the package.

FIG. 4 separately shows the layers 21, 22 of the lidding film 20. In this specification the terms "lower", "lowest", "higher", "highest", "above" and "below" are used to describe the layers of the lidding film with respect to a tray lying on a horizontal surface. Layer 21 is the lowest layer, for attaching to the tray 10. Layer 22 is above layer 21 in the assembled laminate. The cut line 25 is defined in layer 21 but not layer 22. A lower surface of layer 21 can carry a line of heat seal adhesive 15 for use in forming the welded seal with the rim of the tray 10. Layer 22 does not have any cut lines. A resealable adhesive, such as a peelable pressure sensitive adhesive (PSA) 23, is provided between layers 21, 22. The resealable adhesive may be present across the entire region between layers 21 and 22. Alternatively, the resealable adhesive may be present only in the peripheral region 31 where a resealable seal is required. In other regions a permanent laminating adhesive can be used. In use, the second layer 22 can be peeled away from the first layer 21. The second layer 22 separates from the first layer 21 in the peripheral region 31. The second layer 22 remains laminated to the first layer 21 in the inner region 32, so that when the lid is opened a user can gain access to the tray.

The layers 21, 22 can be formed of the same material (e.g. PET or similar) or they can be formed of different materials. An example range of thicknesses for each layer 21, 22 is 12-200 μm. For a package which is intended for storage in a freezer, the ovenable lidding film should also be capable of withstanding low temperatures, such that the material is able to withstand an overall temperature of, for example, −40° C. to +220° C.

Figure 5A:
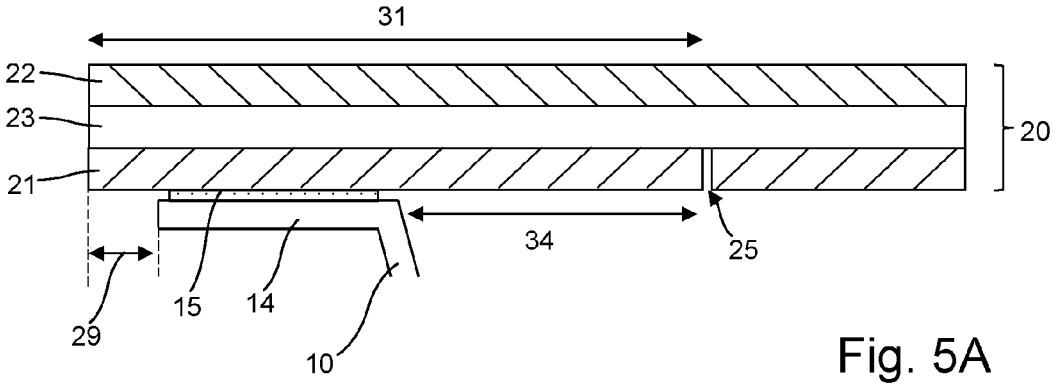
FIGS. 5A-5D show a sequence of states during use of the package.
Figure 5B:
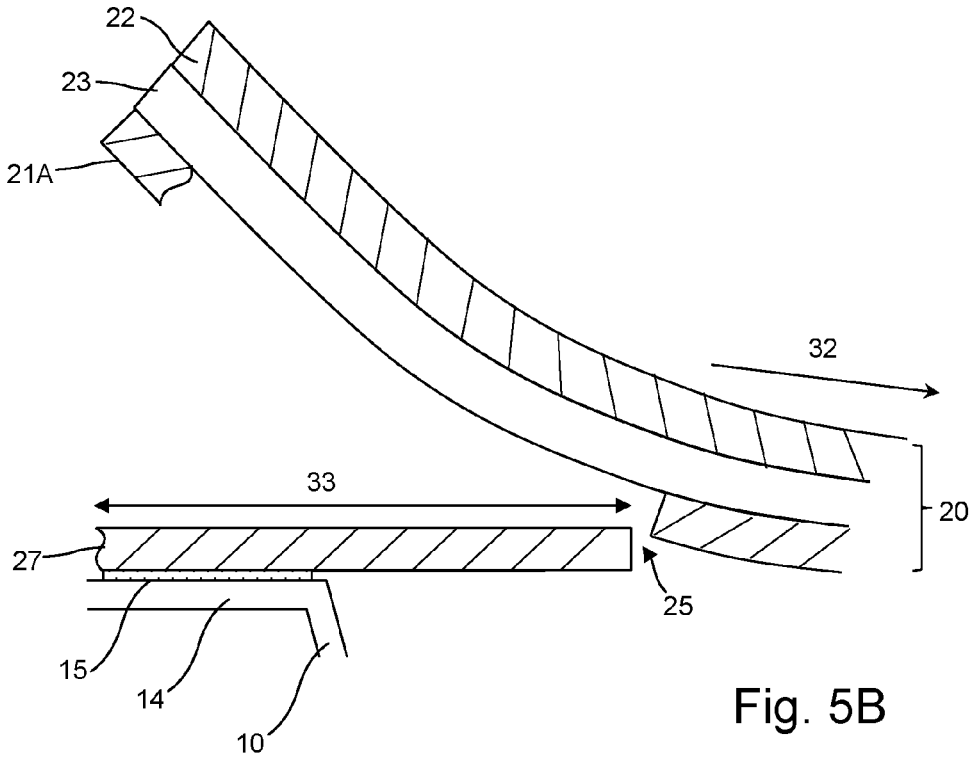
Figure 5C:
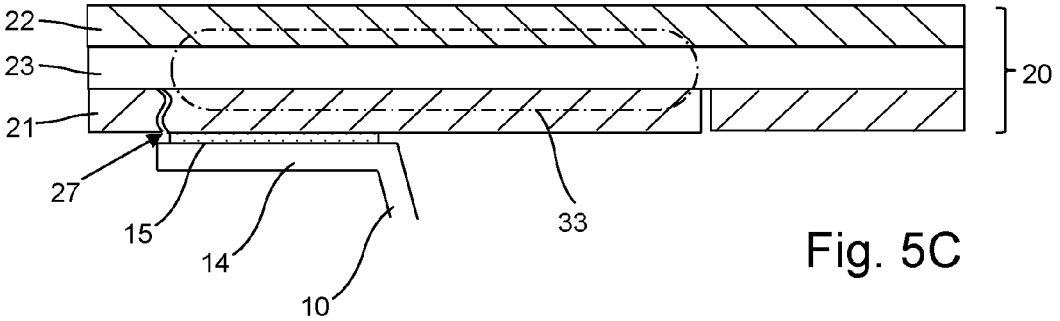

FIGS. 5A to 5C show a sequence of opening the package. The detail of the region along cross-section A-A', through the rim of the tray, is shown in these drawings. FIG. 5A shows the package in an initial, unopened, state. The lidding film 20 extends a short distance beyond the rim 14 of the tray 10. A lower face of the lidding film 20 is sealed to the rim 14 of the tray 10 by adhesive 15. Layers 21, 22 are laminated together by resealable adhesive 23. The first layer 21 has a cut line 25. In this example, the cut line 25 extends fully through the layer 21. The resealable seal provides an airtight seal to the package until the lidding film is first opened. The contents of the tray 10 are protected from the surrounding environment. Typically, the package is stored in a chilled or frozen environment (e.g. fridge or freezer) before heating. The package may be defrosted before heating, or heated directly from frozen. Alternatively, the package may be stored in an ambient environment before heating.

FIG. 5B shows the package in an initially opened state. A user opens the package in this way prior to heating the package. A user grasps the lidding film 20, such as by grasping the tab region 28, and then lifts the lidding film away from the tray 10. This causes the upper layer 22 to separate from the lower layer 21 in region 33, as far as cut line 25. This separation occurs because the opening force applied by the user is greater than the bond strength of the resealable adhesive 23. In this example, the resealable adhesive 23 is more strongly attached to the second layer 22 than the first layer 21 such that the resealable adhesive 23 is carried by the second layer 22 when the second layer is separated from the first layer, as shown here. In an alternative example, the adhesive can remain attached to lower layer 21. Inwardly of the cut line 25, the upper layer 22 remains laminated to the lower layer 21. The inner portion 32 of the first layer 21 remains laminated to the second layer 22.

At the tab 28, and near to the tab, the outermost portion 21A of layer 21 will remain attached to the adhesive 23 and upper layer 22 (as shown in FIG. 5B). The lower layer 21 will rupture at point 27, leaving an irregular edge to the severed parts of the first layer 21. This provides evidence that the package has been opened. Further away from the tab 28, when the lid is pulled back, the outermost portion 21A of layer 21 may separate through the break at 27, which occurs due to the bond at heat seal 15 being stronger than layer 21 itself. In this case, at some point around the rim 14 there will be a transition between the place where the outermost portion 21A of layer 21 is present and a place where the outermost portion 21A of 21 is not present. This also provides evidence that the package has been opened. The lid 20 may be pulled back along the full extent of the cut line 25, or for a lesser extent of the cut line 25.

After pulling back the lidding film 20 as shown in FIG. 5B, the user recloses the lidding film 20. The user may lightly run their finger along the lid 20 in the region where the second layer 22 of the lidding film 20 separated from the peripheral region 31 of the first layer 21, or may brush their hand across the lidding film 20 in a sweeping action. This can help to re-attach the second layer 22 of the lidding film 20 separated from the peripheral region 31 of the first layer 21. FIG. 5C shows this ventable state of the package. FIG. 5C is similar to FIG. 5A. In region 33 the second layer 22 re-attaches to the first layer 21 due to the resealable adhesive 23. The offsetting of cut line 25 inwardly from the rim 14 provides a region where the first layer 21 can be re-attached to the second layer 22. However, due to the initial opening of the lidding film at FIG. 5A, the bond strength of the seal in region 33 is weakened. This reduction in bond strength is desirable, as the lid only needs to re-attach to the first layer to hold the lid in place. The reduced bond strength permits venting. Another difference compared to FIG. 5A is that the first layer 21 will be ruptured 27 around at least some of the perimeter of the lid. This provides evidence of tampering.

Subsequent to FIG. 5C, the package is heated in an oven. During heating, gas can safely vent from the interior volume of the package. The second layer 22 can separate from the first layer 21 in region 33 to allow gas to vent. The lidding film continues to cover the tray. This prevents food escaping from the package, such as hot liquid splashing the interior of the oven.

At some point during the heating process, the package may be removed from the oven to stir the contents. The lid 20 can be pulled back, similar to as shown in FIG. 5B, and then reclosed as shown in FIG. 5C and returned to the oven. An advantage of the package is that the lid can be secured back to the package after opening, thereby preventing splashing.

Figure 5D:
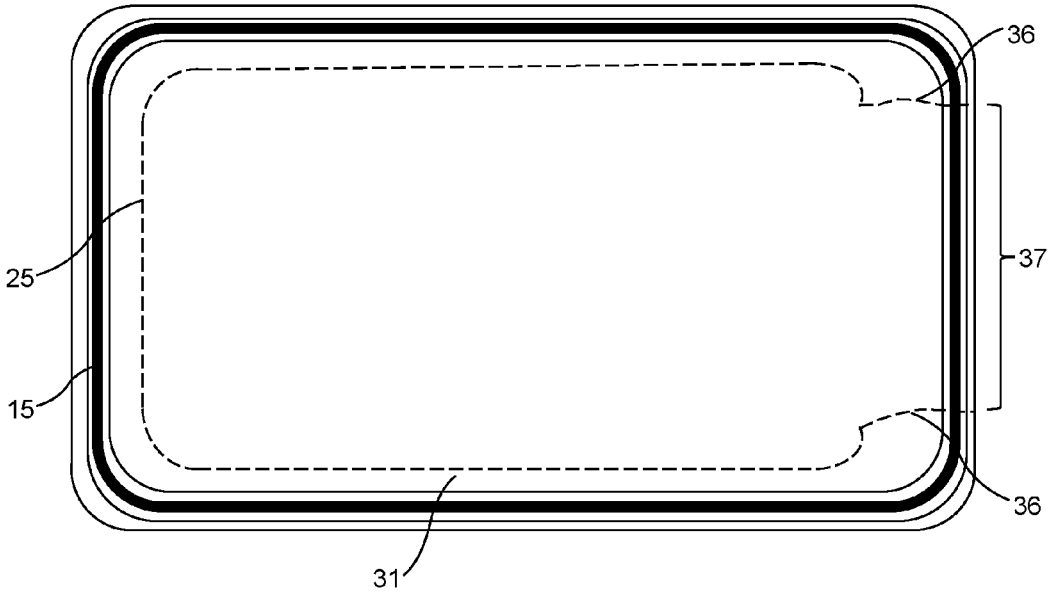

At the end of the heating process the package is removed from the oven. The lid 20 is fully pulled back. It is also possible to remove the lid from the tray 10 by pulling the lid fully back. FIG. 5D shows a plan view of the tray after the lid has been removed from the tray. Pulling the lid back beyond the end of cut line 25 will severe through both layers 21, 22 of the lid along path 36, leaving only the peripheral portion 31 of the lid attached to the rim of the tray 10. This is particularly useful when the contents of the tray require pouring from the tray. The lip 31 of lidding film is not present in region 37 after removal of the lid. This allows easy pouring from the hinge end of the tray in region 37. The food contents can be consumed from the tray 10, or can be transferred from the tray 10 before consumption.

Another advantage of the package is that it can allow the package to be opened (at FIG. 5B) to remove an item from the interior of the package before heating. For example, some pre-prepared food has an item which requires a shorter heating time than the remainder of the package. In a conventional package this need to pull back the lidding film to remove the item can cause splashing and/or poorer heating of the food when the opened package is heated.

Figure 5E:
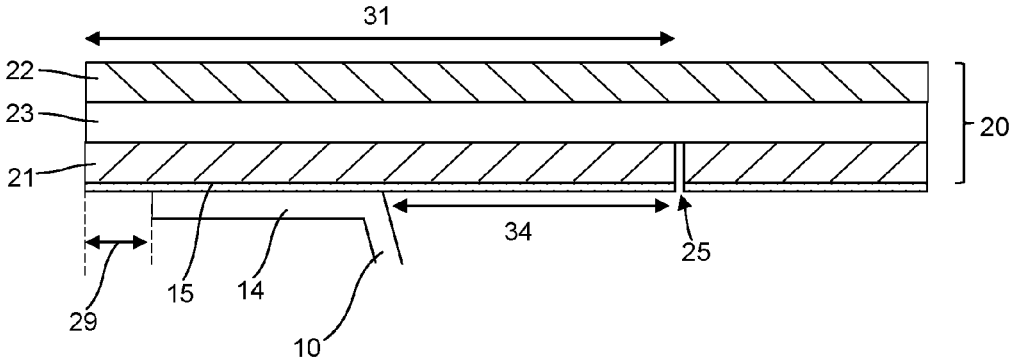
FIG. 5E shows an alternative package with an adhesive layer across the film lid.

For completeness, FIG. 5E shows another example of the package with a lidding film 20 having heat seal adhesive 15 applied as a layer across the lidding film.

A non-limiting example range of bond strength for the resealable adhesive 23 in the initial unopened state is 100 g-400 g per 25 mm. This reduces after the package is initially opened. A non-limiting example range of bond strength for the resealable adhesive 23 in the ventable state is 50 g-100 g per 25 mm.

Figure 6:
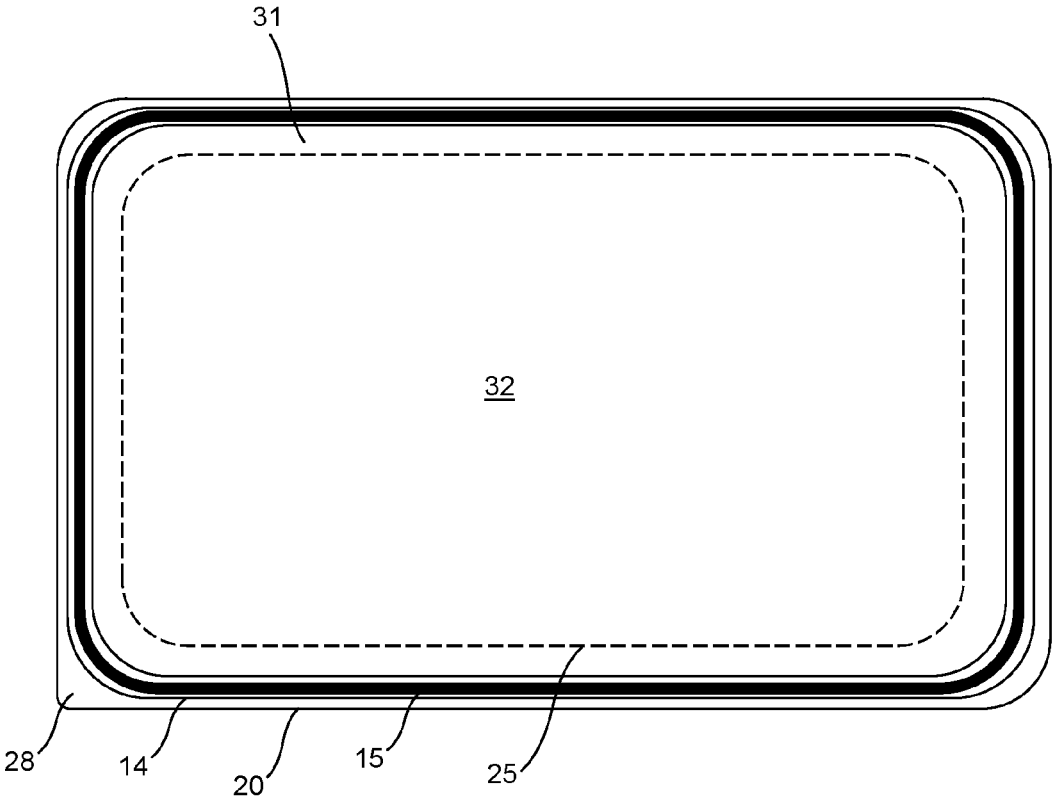
FIG. 6 shows an example of a package with a removable lid.

FIG. 6 shows an example of a package with a removable lid. The cut line 25 follows a closed path. The cut line 25 is offset from the rim 14 around the full perimeter of the rim. The lid operates as previously shown in FIGS. 5A to 5C. When the lid is first opened, it is pulled back, but not separated from the tray 10. When the food is ready for consumption, the lid 20 can be fully pulled back and removed from the tray 10.

Figure 7A:
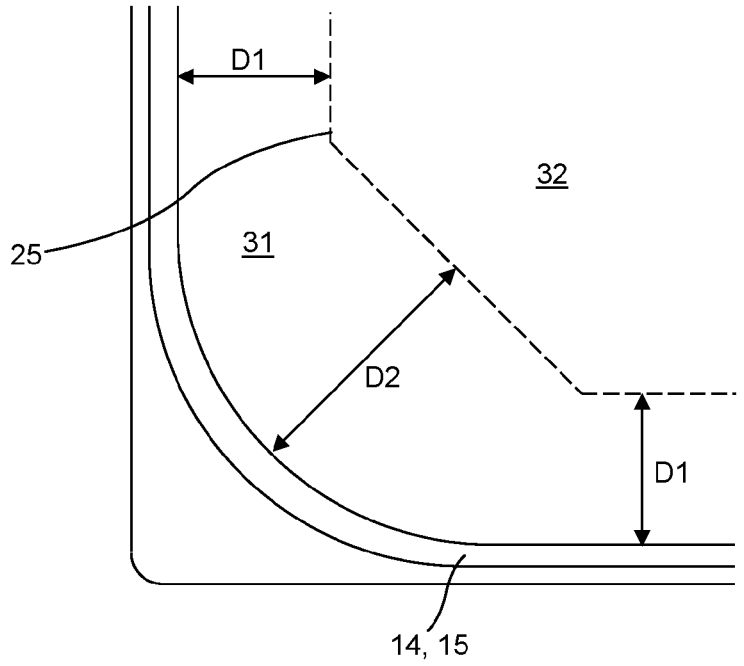
FIGS. 7A and 7B show examples of a package with an anti-scald feature.
Figure 7B:
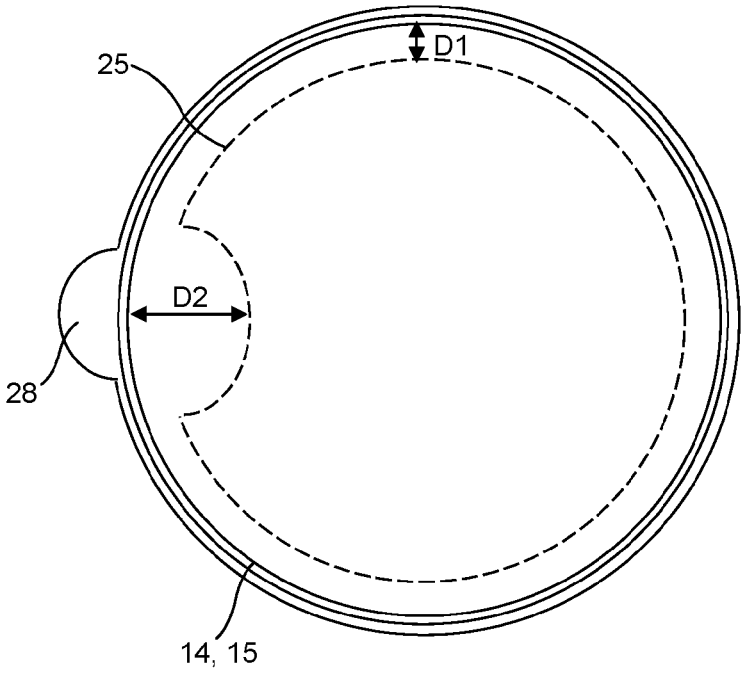

FIGS. 7A and 7B show an anti-scald feature of a package. In FIG. 7A, only the corner of a package is shown. The peripheral portion 31 of the first, lower, layer 21 is defined by a cut line 25. The cut line 25 is offset by a distance D1 from the rim 14 and heat seal 15 around the tray. The lidding film 20 has a tab 28 which a user can grasp to open the package. In a region adjacent the tab 28, the cut line is offset by a larger distance from the rim 14 and heat seal 15. In the example of FIG. 7A, the cut line 25 does not follow the shape of the rim at the corner but, instead, follows a diagonal path at the corner. The cut line is offset by an increased distance of up to D2 from the rim 14, where D2>D1. This larger offset provides scald protection to a user because the user's fingers are separated by a larger distance from any hot gases which escape from the package when the film is pulled back. The scalding risk is reduced.

While FIG. 7A shows a cut line offset by an increased distance at a corner of a receptacle, the cut line may be modified in this way at any position around the receptacle. FIG. 7B shows an example of a receptacle which is circular in plan view. The cut line 25 is offset by a distance D1 from the rim 14 and heat seal 15 around most of the circumference of the rim. The cut line 25 is offset by an increased distance of up to D2 adjacent a tab 28 on the lid. The same benefit of reduced scalding is obtained. The package shown in FIG. 7A or 7B can be combined with the features of any of the other described packages.

Figure 8A:
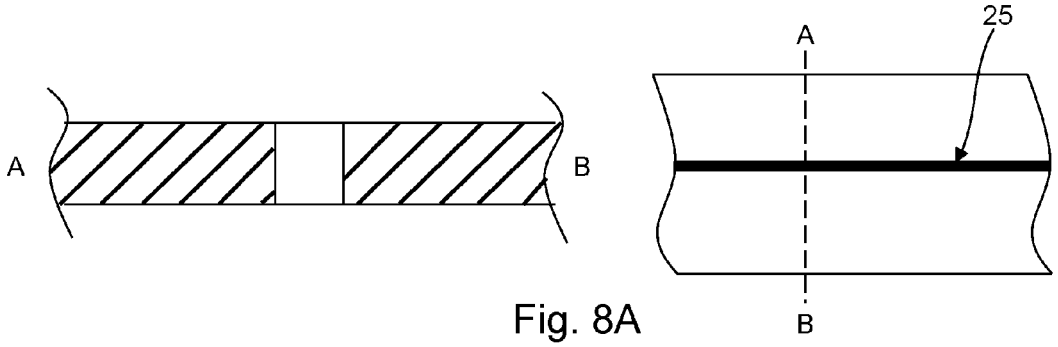
FIGS. 8A-8D show examples of cut lines.

In the above examples, a cut line 25 is formed in the first layer 21. FIG. 8A shows a cross-section through the first layer 21 and a plan view of the first layer 21. FIG. 8A shows a cut line 25 which is continuous along the surface, as shown in the plan view. The cut line extends fully through the layer, as shown in the cross-section A-B. B. As there is a continuous cut fully through the layer, the layer will easily separate along the cut line 25.

Figure 8B:
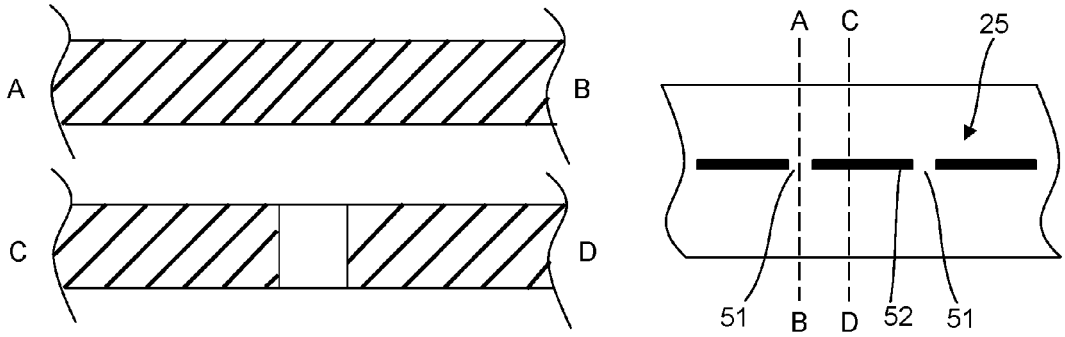
Figure 8C:
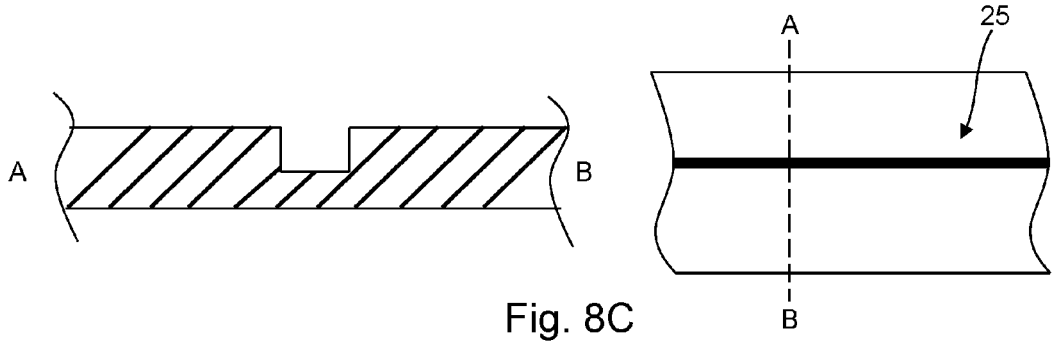
Figure 8D:
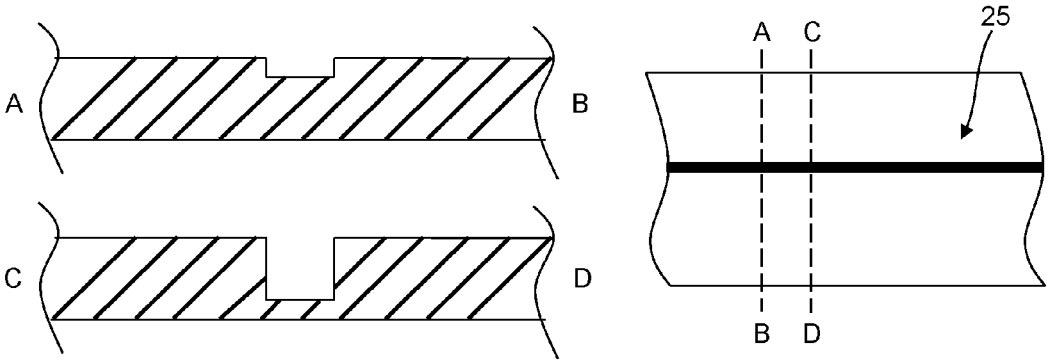

FIGS. 8B-8D show some other examples of cut lines 25 which can be formed in the first layer 21 of the laminate lid 20. Each of FIGS. 8B-8D show a cross-section through the first layer 21 and a plan view of the first layer 21. The example cut lines shown in FIGS. 8B-8D can provide improved evidence of when the package has been tampered with.

FIG. 8B shows a cut line 25 which is discontinuous along the surface, as shown in the plan view. This type of cut line is a perforated cut line. This type of cut line is an example of a line of weakness. The cut line comprises non-perforated portions 51 where the layer has not been cut and remains intact, as shown in the cross-section A-B. The cut line also comprises perforated portions 52 where the cut line extends fully through the layer, as shown in the cross-section C-D. The layer is weakened along the cut line. When a force is applied to the cut line by applying an opening force to the lid, the force will rupture the non-perforated portions 51 and the layer will separate along the cut line 25.

FIG. 8C shows a cut line which is continuous along the surface, as shown in the plan view. The cut line extends partially through the layer, as shown in the cross-section A-B. This type of cut line is a score line or scribe line. This type of cut line is an example of a line of weakness. The layer is weakened along the cut line. When a force is applied to the line of weakness by applying an opening force to the lid, the force will rupture the cut line.

FIG. 8D shows a cut line which is continuous along the surface, as shown in the plan view. The cut line extends partially through the first layer. The depth of the cut varies along the cut line. Two cross-sections are shown. At cross-section A-B the cut extends a first depth into the layer. At cross-section C-D the cut extends a second depth into the layer. The second depth is greater than the first depth. This type of cut line can be called a crenellated line. The line can alternate between the cut depths shown in the two cross-sections along the length of the line. The first depth may be zero, such that the line has some portions which are not cut at all, and some portions where the cut line extends partially into the layer. The layer is weakened along the cut line. When a force is applied to the line of weakness by applying an opening force to the lid, the layer will separate along the line of weakness.

In any of the examples, the cut line 25 may be formed by a laser cutting machine, or by a die cutting machine. The cut line may be formed in the first layer 21 before laminating the layers 21, 22 together. Alternatively, it is possible to form the cut line 25 after lamination of the layers 21, 22.

Figure 9:
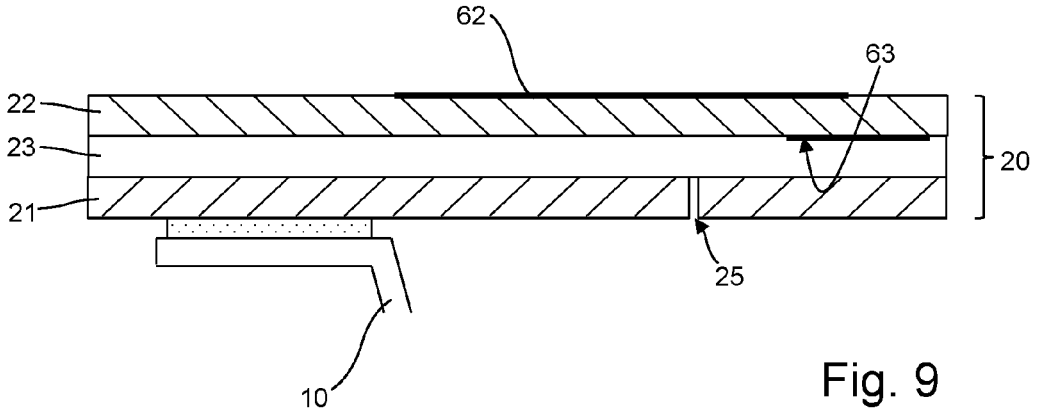
FIG. 9 shows two alternative ways of printing the package.
Figure 10:
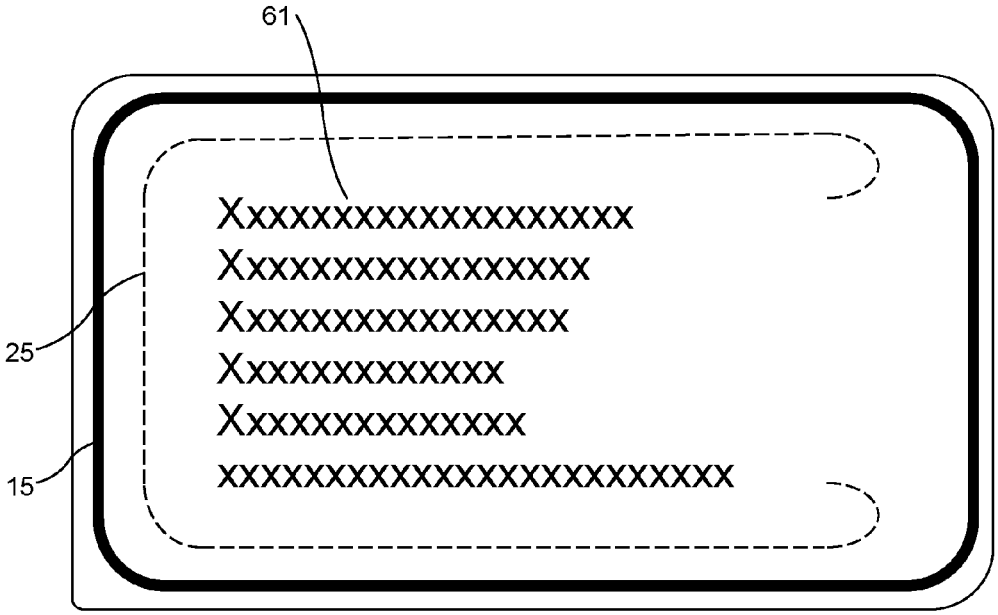
FIG. 10 shows a package with printing.

The package 5 may comprise a sleeve which fits around the tray 10. The sleeve may provide protection to the package, and carry information about the contents, such as product, branding, weight, ingredients, nutritional information, recycling information, regulatory information. The lidding film 20 of the package may carry printing. FIG. 9 shows two ways in which the package may be printed. The printing may be provided 62 on an external face of the upper (outer) layer 22. Alternatively, the printing may be provided 63 on an inner face of the upper (outer) layer 22. The upper layer 22 can be reverse printed before the second layer 22 is laminated to the first layer 21. Advantageously, the printing 63 can be restricted to a region of the lidding film within the cut line 25, or within a region which is offset from the cut line 25 by a defined distance. This is shown by printing 61 in FIG. 10. This can help prevent any migration of chemicals used for the printing into the interior of the package, as the printing will remain within the laminated region of the lidding film 20.

Figure 11:
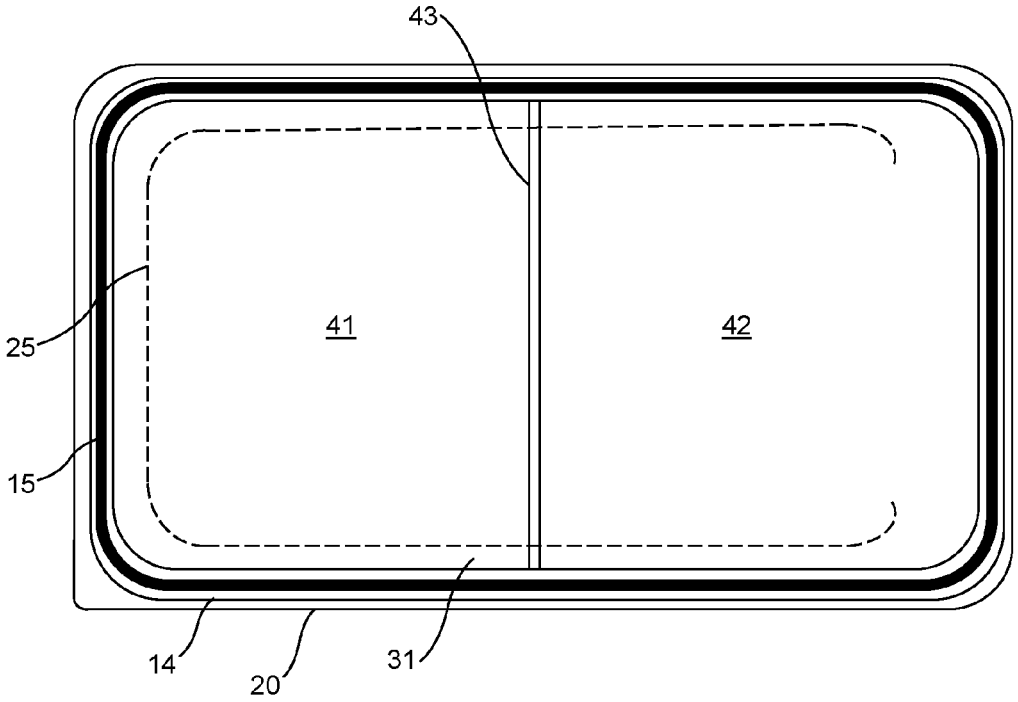
FIG. 11 shows a package with multiple compartments.
Figure 12:
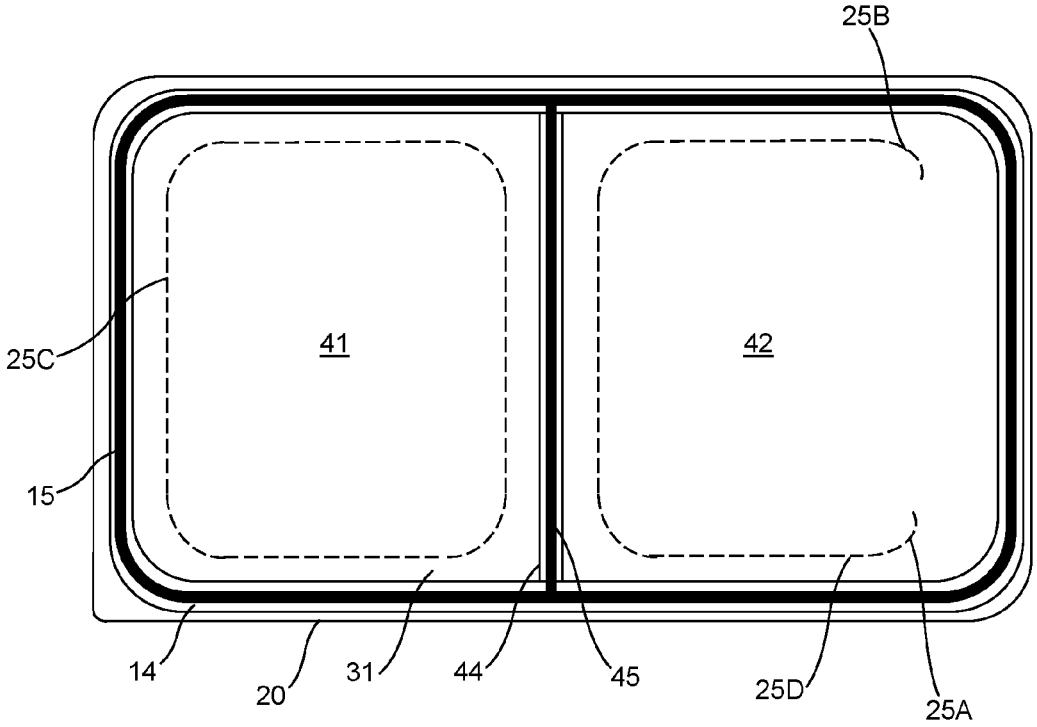
FIG. 12 shows another package with multiple compartments.

The example packages illustrated so far have a single compartment for holding a food product. Any of the features described above can be applied to a package having multiple compartments. FIGS. 11 and 12 show examples of packages with more than one compartment. FIG. 11 shows a package similar to the one shown in FIG. 2. A dividing wall 43 within the receptacle (e.g. tray) divides the receptacle into two compartments 41, 42. The dividing wall 43 can extend up to the height of the rim 14, or can be of a lower height than the rim 14. FIG. 12 shows another package. A dividing wall 44 within the receptacle (e.g. tray) divides the receptacle into two compartments 41, 42. In this example, the dividing wall 44 extends up to the same height as the rim 14. The lidding film 20 is attached to the top surface of the dividing wall 44. A welded seal 45 is formed between a lower face of the lidding film 20 and the dividing wall 44. The welded seal 45 can be continuous with the welded seal 15 around the outer rim of the receptacle. In the example shown in FIG. 12, a first compartment 41 nearest the tab has a cut line 25C with a closed path and a second compartment 42 furthest from the tab has a cut line 25D with defined ends 25A, 25B. In use, when the tab is pulled, the second layer separates from the first layer to leave a peripheral region 31 around the first compartment 41 and a peripheral region 31 around the second compartment 42. The second layer of the lidding film separates from the first layer of the lidding film above the dividing wall 44. In FIGS. 11 and 12, the dividing wall 43, 44 may have a different size, shape (e.g. non-linear) and/or position to the one shown. A larger number of dividing walls 43, 44 can be provided, to provide a larger number of compartments.

A package having two layers has been described above. It is possible to add one or more further layers to the laminate.

The lidding film 20 can be supplied in the form of a web or reel of laminate material. The web is a continuous length of laminate material. The web can be divided into individual pieces to provide the lidding film for an individual package. The heat seal adhesive can be applied to the web at the time of manufacture, or at a later point in time, such as when printing an exterior surface of the film, or just prior to forming the package.

In any of the examples of the package, the resealable adhesive can be an oven grade PSA.

It will be understood that the benefits and advantages described above may relate to one embodiment or may relate to several embodiments. The embodiments are not limited to those that solve any or all of the stated problems or those that have any or all of the stated benefits and advantages.

Any reference to 'an' item refers to one or more of those items. The term 'comprising' is used herein to mean including the method blocks or elements identified, but that such blocks or elements do not comprise an exclusive list and a method or apparatus may contain additional blocks or elements.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

It will be understood that the above description of a preferred embodiment is given by way of example only and that various modifications may be made by those skilled in the art. Although various embodiments have been described above with a certain degree of particularity, or with reference to one or more individual embodiments, those skilled in the art could make numerous alterations to the disclosed embodiments without departing from the spirit or scope of this invention.

The invention claimed is:

1. An ovenable package comprising:

an ovenable receptacle configured to hold a food product, the receptacle having an open face surrounded by a rim;

an ovenable laminated film lid attached to the rim of the receptacle by a welded seal between a lower face of the laminated film lid and the rim of the receptacle, the welded seal extending continuously around the rim of the receptacle, the laminated film lid comprising at least:

a first layer;

a second layer above the first layer;

a first cut line in the first layer but not the second layer, the first cut line offset inwardly from the rim of the receptacle to define a peripheral portion of the first layer between the first cut line and an outer perimeter of the lid and an inner portion of the first layer within the first cut line; and a resealable adhesive between at least the peripheral portion of the first layer and the second layer;

wherein an unopened package is openable by separating the second layer from the first layer in a peripheral region, and wherein the opened package can be reclosed to a ventable state by reattaching the second layer to the peripheral region of the first layer by the resealable adhesive, wherein the ventable state permits venting of gas from an interior of the receptacle between the second layer and the peripheral region of the first layer.

2. The ovenable package according to claim 1 wherein the resealable adhesive is more strongly attached to the second layer than the first layer such that the resealable adhesive is carried by the second layer when the second layer is separated from the first layer.

3. The ovenable package according to claim 1 wherein the inner portion of the first layer is a flap, the first cut line defining an open path with a first end point and a second end point.

4. The ovenable package according to claim 1 wherein the first cut line forms a closed path.

5. The ovenable package according to claim 1 wherein the laminated film lid extends beyond the rim of the receptacle.

6. The ovenable package according to claim 1 wherein the laminated film lid comprises a tab portion, the film lid extending beyond the rim by a greater distance at the tab portion compared to a remainder of the film lid.

7. The ovenable package according to claim 6, wherein the first cut line is offset inwardly from the rim by a larger distance proximate the tab portion.

8. The ovenable package according to claim 7 wherein the tab portion is located at a corner of the receptacle, wherein the first cut line is offset inwardly from the rim by a larger distance at the corner of the receptacle.

9. The ovenable package according to claim 1 wherein only the resealable adhesive is provided between the first layer and the second layer.

10. The ovenable package according to claim 9 wherein a bond strength of the resealable adhesive is lower on the peripheral portion of the first layer compared to the inner portion of the first layer.

11. The ovenable package according to claim 1 wherein a permanent adhesive is provided between the inner portion of the first layer and the second layer.

12. The ovenable package according to claim 1 wherein the laminated film lid is printed on an outer face of the second layer.

13. The ovenable package according to claim 1 wherein the laminated film lid is printed between the second layer and the first layer.

14. The ovenable package according to claim 13 wherein the laminated film lid is printed between the second layer and the first layer only above the inner portion of the first layer.

15. The ovenable package according to claim 1 wherein the receptacle further comprises a dividing wall which divides the receptacle into a plurality of compartments.

16. The ovenable package according to claim 15 wherein the ovenable laminated film lid is also attached to a top surface of the dividing wall.

17. An ovenable laminated film lid configured to attach to a rim of an ovenable receptacle to hold a food product, the ovenable laminated film lid comprising:

a first layer configured to seal to the rim of the receptacle;

a second layer above the first layer;

a first cut line in the first layer but not the second layer, the first cut line offset inwardly from the rim of the receptacle to define a peripheral portion of the first layer between the first cut line and an outer perimeter of the lid and an inner portion of the first layer within the first cut line; and a resealable adhesive between at least the peripheral portion of the first layer and the second layer;

wherein the lid is openable by separating the second layer from the first layer in a peripheral region, and wherein the lid can be reclosed to a ventable state by reattaching the second layer to the peripheral region of the first layer by the resealable adhesive, wherein the ventable state permits venting of gas from an interior of the receptacle between the second layer and the peripheral region of the first layer.

* * * * *